US010900431B2

(12) United States Patent
Raindl

(10) Patent No.: US 10,900,431 B2
(45) Date of Patent: Jan. 26, 2021

(54) METHOD FOR DETERMINING SPARK PLUG ELECTRODE SPACING AND STATE OF WEAR

(71) Applicant: MTU FRIEDRICHSHAFEN GMBH, Friedrichshafen (DE)

(72) Inventor: Markus Raindl, Ravensburg (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 46 days.

(21) Appl. No.: 15/740,942

(22) PCT Filed: Jul. 1, 2016

(86) PCT No.: PCT/EP2016/001122
§ 371 (c)(1),
(2) Date: Dec. 29, 2017

(87) PCT Pub. No.: WO2017/012695
PCT Pub. Date: Jan. 26, 2017

(65) Prior Publication Data

US 2018/0187620 A1 Jul. 5, 2018

(30) Foreign Application Priority Data

Jul. 17, 2015 (DE) ..... 10 2015 009 248

(51) Int. Cl.

| | |
|---|---|
| ***F02D 41/14*** | (2006.01) |
| ***F02P 17/12*** | (2006.01) |
| ***F02D 41/00*** | (2006.01) |
| ***F02D 35/02*** | (2006.01) |
| ***H01T 13/58*** | (2020.01) |
| ***F02D 41/22*** | (2006.01) |

(52) U.S. Cl.
CPC ..... *F02D 41/1406* (2013.01); *F02D 35/023* (2013.01); *F02D 41/0027* (2013.01); *F02P 17/12* (2013.01); *H01T 13/58* (2013.01); *F02D 41/221* (2013.01); *F02D 2200/02* (2013.01); *F02P 2017/121* (2013.01)

(58) Field of Classification Search
CPC ..... F02D 41/1406; F02D 41/0027; F02D 35/023; F02D 2200/02; F02D 41/221; F02D 2700/02; F02P 17/12; F02P 2017/121; H01T 13/58; B60W 2510/0619; B60W 2710/0622; F02B 19/1052
USPC ..... 701/103
See application file for complete search history.

(56) References Cited

FOREIGN PATENT DOCUMENTS

| | | | |
|---|---|---|---|
| DE | 19756336 C1 * | 4/1999 | ..... F02D 35/023 |
| DE | 19756336 C1 | 4/1999 | |

(Continued)

*Primary Examiner* — Joseph J Dallo
*Assistant Examiner* — Scott A Reinbold
(74) *Attorney, Agent, or Firm* — Lucas & Mercanti, LLP; Klaus P. Stoffel

(57) ABSTRACT

A method for implementation with the operation of an internal combustion engine, having an ignition plug, which is arranged on a combustion chamber of a cylinder of the internal combustion engine, wherein: in a first step, a cylinder pressure at the ignition time at the combustion chamber is detected, as well as a breakdown voltage at the ignition plug; and in a second step, a current electrode distance of the ignition electrodes, representing a current ignition electrode wear state, is determined based on the detected cylinder pressure, the detected breakdown voltage and a constant of proportionality.

11 Claims, 1 Drawing Sheet

F

(56) References Cited

FOREIGN PATENT DOCUMENTS

| | | | | | |
|---|---|---|---|---|---|
| DE | 102013010685 | A1 | * | 12/2014 | ..... F02P 5/151 |
| DE | 102013010685 | A1 | | 12/2014 | |
| JP | 10189213 | A | * | 7/1998 | |
| JP | H10189213 | A | | 7/1998 | |
| JP | 2008101585 | A | * | 5/2008 | |
| JP | 2008101585 | A | | 5/2008 | |

* cited by examiner

METHOD FOR DETERMINING SPARK PLUG ELECTRODE SPACING AND STATE OF WEAR

The present application is a 371 of International application PCT/EP2016/001122, filed Jul. 1, 2016, which claims priority of DE 10 2015 009 248.0, filed Jul. 17, 2015, the priority of these applications is hereby claimed and these applications are incorporated herein by reference.

BACKGROUND OF THE INVENTION

The present invention relates to a method for implementation with the operation of an internal combustion engine.

Spark plugs in use with spark ignition engines, in particular also gas engines, are subject to considerable fluctuations with respect to their service life. For example, an engine with a variable rotational speed and load is therefore operated with low combustion-accelerating air/fuel ratios in order to satisfy transient times, said ratios giving rise to high combustion chamber temperatures and to a high degree of wear on the spark plug as a result of the additional heat flow in the wear element of the spark plug. This increased wear has a high degree of variation with respect to the service life reliability, which can disadvantageously lead to an unexpected failure.

SUMMARY OF THE INVENTION

Taking the above as a starting point, the present invention is based on the object of specifying a method on the basis of which it is possible to predict a failure.

The invention proposes a method for implementation with the operation of an internal combustion engine which has a spark plug which is arranged on a combustion chamber of a cylinder of the internal combustion engine. The internal combustion engine is preferably e.g. a gas engine, generally preferably a spark ignition engine, and within the scope of the present invention in particular a large engine, and also in particular a large engine running in lean operation, e.g. for a utility vehicle such as a ship, a special vehicle, e.g. also for industrial applications.

The spark plug is preferably a prechamber spark plug which can have, in a manner known per se, a spark plug housing or a spark plug body, and also a prechamber cap, which, together with the spark plug housing, defines a pre-combustion chamber of the spark plug, i.e. a prechamber. The spark plug has an (ignition) electrode arrangement, in particular preferably accommodated in the pre-combustion chamber, the ignition electrodes of which are at a distance from one another, i.e. have an electrode spacing (at the spark gap). The electrode arrangement comprises, in particular, a central electrode and at least one ground electrode which define the electrode spacing with respect to one another (which spacing varies, in particular increases, with the burning off of the electrodes over the service life of the spark plug). The spark plug which is arranged on the combustion chamber is also provided for spark ignition of the fuel mixture which is input into the combustion chamber.

In the proposed method, which is preferably coordinated by a superordinate sequence controller of the internal combustion engine, e.g. an ECU (Electronic Control Unit; central engine control unit) or generally a control unit, in a first step (during an ignition process) a cylinder pressure is measured or determined at the combustion chamber at the ignition time and a breakdown (ignition) voltage is measured or determined at the spark plug (in this context the time of the triggering of the ignition spark at the spark plug is referred to as the ignition time within the scope of the invention).

In this context, a cylinder pressure sensor is provided for measuring the cylinder pressure, while the breakdown voltage can be measured by means of a device which is suitable for this purpose. Such a device can comprise e.g. a measuring arrangement with high time resolution, i.e. which supplies measurement signals in the gigahertz range and which taps voltage signals, e.g. on an ignition voltage line (to the spark plug), in order to make available the breakdown voltage information, or e.g. on a measuring line.

In a second step of the method, a current electrode spacing of the ignition electrodes, which represents a current ignition electrode state of wear, is now determined on the basis of the measured cylinder pressure, the measured breakdown voltage and a (proportionality) constant. For this purpose the equation 1) can be used in a way corresponding to Paschen's law, according to which:

$$EA = \frac{U_{ZZP}}{p_{zzp}K}, \qquad \text{Equation 1)}$$

where the (current) electrode spacing is denoted by "EA", the breakdown voltage (at the ignition time) is denoted by "$U_{ZZP}$", the cylinder pressure (at the ignition time) is denoted by "$p_{zzp}$", and the proportionality constant is denoted by "K".

On the basis of the determined current electrode spacing, a reliable failure prediction with respect to the spark plug is advantageously made possible, i.e. the determined electrode spacing advantageously serves as a wear indicator (since, as already mentioned, the electrode spacing generally with the time for which the spark plug has been operating, in particular generally increasing over the service life of the spark plug, i.e. as a result of burning off (melting off) of the ignition electrodes). As a result, an accurate predication also makes it possible to reduce the otherwise customary impacts on the service life in terms of reliability, with the result that the wear-related costs can be advantageously reduced.

The proportionality constant which is used in the second step is preferably determined as a system-specific variable at the internal combustion engine, in particular once, and is based, in particular, on a previously known electrode spacing of the spark plug, and also on a cylinder pressure which is determined in a way corresponding thereto at the ignition time, and a breakdown voltage of the spark plug which is in turn determined in a way which corresponds thereto. The previously known electrode spacing is defined e.g. by the manufacturer, e.g. that electrode spacing according to the delivery state of the spark plug. The proportionality constant is determined e.g. on a measuring setup composed of the internal combustion engine, and the measuring technology for the ignition voltage and cylinder pressure, wherein the engine is preferably adjusted to a predetermined operating point. The proportionality constant or Paschen's constant can then be determined with the known electrode spacing as:

$$K = \frac{U_{ZZP}}{p_{zzp}EA_{known}} \qquad \text{Equation 2)}$$

where the previously known electrode spacing is denoted by "$EA_{known}$", the breakdown voltage (at the ignition time) is denoted by "$U_{ZZP}$", the cylinder pressure (at the ignition time) is denoted by "$p_{zzp}$", and the proportionality constant is denoted by "K". The proportionality constant depends e.g. on the gas mixture at the spark gap (gap between the electrodes), the work function of the electrons, the material of the electrodes and other parameters, with the result that the proportionality constant is preferably determined on a system-specific basis (system composed of the internal combustion engine and spark plug) within the scope of the invention.

In a preferred development of the method, in a further step, which is based on the current electrode spacing of the ignition electrodes which is determined in the second step, a service life of the spark plug is now determined. The determined service life here can be a service life which has past, i.e. an age, alternatively or additionally and preferably a remaining service life. A characteristic curve with which the determined electrode spacing is correlated can be used for the determination of the service life. The end of the service life is reached when the maximum electrode spacing, and consequently the maximum electrode wear, is reached.

The maximum electrode spacing can be determined e.g. for the spark plug as:

$$EA_{max}=EA_{min}+d_{wear\ body}, \qquad \text{Equation 3):}$$

where the maximum electrode spacing which characterizes the end of the service life is denoted by "$EA_{max}$", the initial minimum electrode spacing which characterizes the start of the service life is denoted by "$EA_{min}$", and the thickness of the electrode material which can burn off is denoted by "$d_{wear\ body}$". A service life characteristic curve can now be easily generated, e.g. determined empirically or else in a model-supported fashion, with the known values for $EA_{max}$ and $EA_{min}$.

In a development of the invention, an information signal can be output on the basis of the determined current electrode spacing or the service life determined on the basis thereof, to an operator, in particular prompted by the control unit, i.e. in particular with the objective of bringing about a user intervention in a way appropriate to demand, e.g. a change of the spark plug or deactivation of cylinders.

Furthermore, developments of the method are preferably also provided to the effect that in a further step, e.g. and preferably also in addition to the determination of the service life, at least one combustion parameter of the internal combustion engine is set on the basis of the electrode spacing, which is determined in the second step, or is adjusted to the current electrode spacing, and in particular an air/fuel ratio (lambda) is set or adjusted. By adjusting one or more combustion parameters as a function of the determined electrode spacing, consequently as a function of the age of the spark plug, the age-related effect of the spark plug on the combustion can now be advantageously compensated, by the engine control, and as a result also improved compliance with emission limiting values can be achieved. For example, the ignition energy can now also be made available at the spark plug which is more appropriate for demand (e.g. via ECU (and ignition system)), a combustion period or injection period (combustion period or combustion profile controller) can be adjusted or further parameters can be set as a function of the determined electrode spacing in a way which is favorable for combustion.

A characteristic curve or a model which relates the determined electrode spacing to a combustion parameter, in particular to a conversion point, an air/fuel ratio, an injection period or a parameter which is different therefrom, i.e. for combustion-optimizing correction purposes, can be used with the method to influence parameters in such a way.

With the invention there is provision, in particular, that the method is carried out iteratively and continuously, and consequently the spacing between the ignition electrodes is determined or monitored continuously. Together with this, continuous, electrode-spacing-dependent influencing of the combustion (as explained above) is therefore also provided, and in addition e.g. also continuous determination of the service life and continuous signaling of the service life.

The method also advantageously provides the possibility of checking a respective spark plug for its originality or usability with the internal combustion engine. For this purpose, the method can be carried out with an unused spark plug (and known, system-specific proportionality constant), wherein the determined electrode spacing is compared with a new-state setpoint electrode spacing. If the determined electrode spacing does not correspond to the setpoint spacing, it can be detected that a different spark plug than an original one or than the one provided for use with the internal combustion engine has been arranged on the combustion chamber, e.g. said different spark plug can also be signaled to a user by means of suitable signaling.

Within the scope of the present invention, an internal combustion engine is also proposed which is configured to carry out the method explained above. For this purpose, the internal combustion engine can have, in particular, a cylinder with a combustion chamber, a spark plug which is arranged on the combustion chamber, a cylinder pressure sensor and a device for measuring the breakdown voltage at the spark plug (tap, e.g. on the ignition line), and in addition also preferably a sequence controller or control unit for controlling the method, in particular in the form of the ECU. In the latter and/or a data carrier there can also be program code implemented for carrying out the method, for example also characteristic curves or models which can be used with the method.

Further features and advantages of the invention can be found in the following description of exemplary embodiments of the invention, with respect to the figures in the drawings which show details which are essential to the invention, and in the claims. The individual features can each be implemented individually per se or a plurality thereof can be implemented in various combinations in one variant of the invention.

BRIEF DESCRIPTION OF THE DRAWING

Preferred embodiments of the invention are explained in more detail below on the basis of the appended drawings, in which.

DETAILED DESCRIPTION OF THE INVENTION

Figures 1, 2:
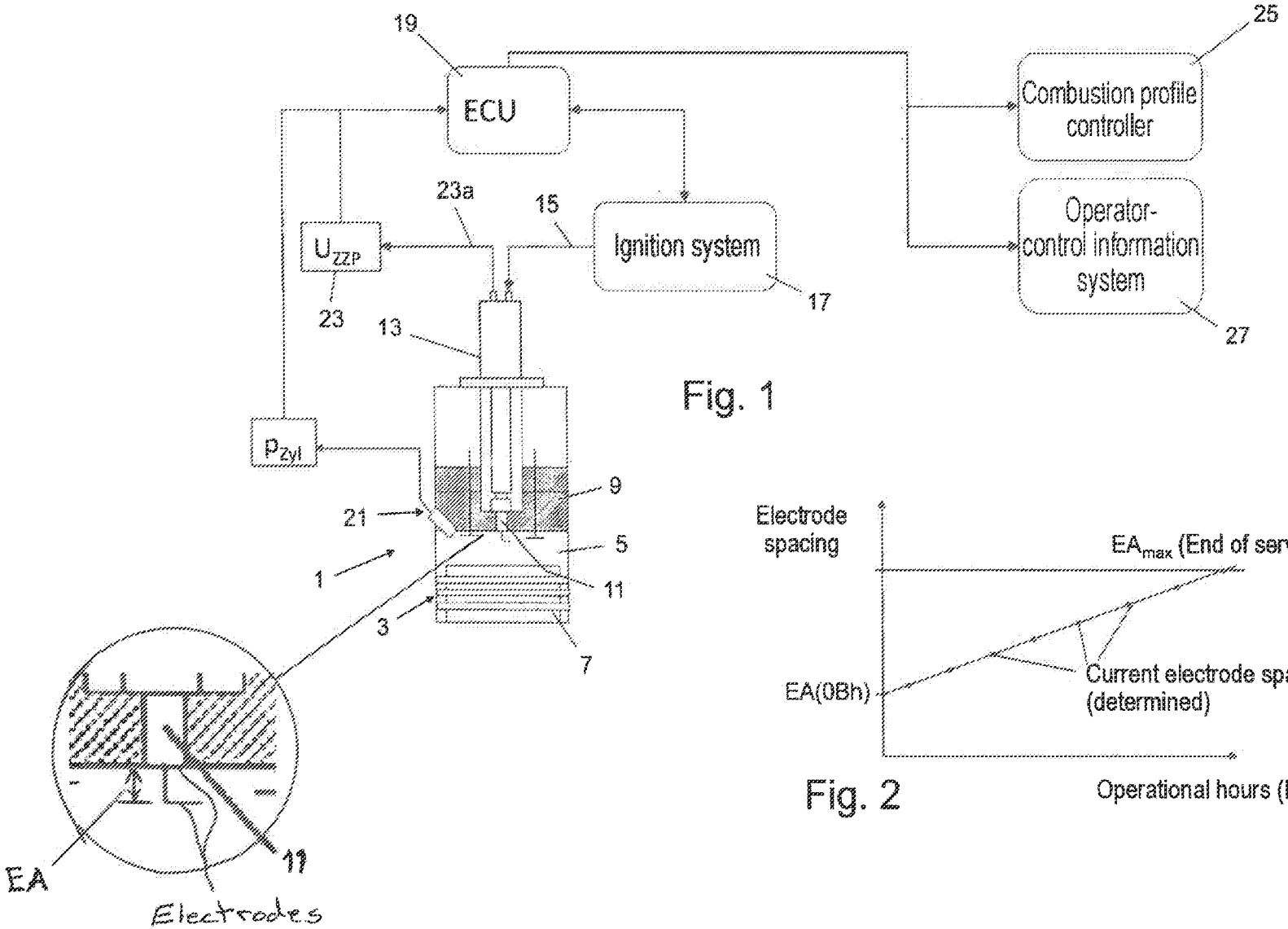
FIG. 1 shows, in an exemplary and highly schematically simplified form, an internal combustion engine which is configured to carry out the method.
FIG. 2 shows, in an exemplary and schematic form, a characteristic curve for determining the service life of the spark plug.

In the following description and the drawings, identical reference symbols correspond to elements with an identical or comparable function.

FIG. 1 shows, in an exemplary and schematic, in particular highly simplified, form, an internal combustion engine 1, with the operation of which the method according to the invention can be implemented. The internal combustion engine 1, made available as a (lean-operation) gas engine with combustion gas injection, e.g. of combustion gas in the form of natural gas, biogas, special gas, landfill gas, hydrogen, has a cylinder 3 in which a combustion chamber 5 is defined, i.e. between a reciprocating piston 7 and a combustion chamber cover 9. A spark plug 11 for igniting the combustion gas/air mixture is arranged on the combustion chamber 5, in particular on the cylinder head or combustion chamber cover 9 of the cylinder 3, projecting in this respect into the combustion chamber 5.

The spark plug 11 is made available as a prechamber spark plug and is connected via a plug connector 13, together with ignition line 15, to an ignition system 17 of the internal combustion engine 1 which receives ignition signals from a superordinate control unit 19, that is to say from an engine controller or ECU. The spark plug 11 is supplied with ignition voltage by the ignition system 17 as a function of the actuation of the ignition system by the ECU 19, with the result that ignition sparks are generated between the electrodes (not illustrated) of the spark plug 11. In this context, the current electrode spacing EA of the ignition electrodes, which comprise a central electrode and a ground electrode, i.e. for forming the spark gap, is decisive for the necessary ignition energy for generating an ignition spark.

As illustrated further in FIG. 1, a cylinder pressure sensor 21, which supplies combustion chamber pressure information $p_{cyl}$ to the engine controller 19, is also arranged on the combustion chamber 5, operatively connected to the combustion chamber 5. In order to measure a breakdown voltage at the spark plug 11, a measuring device 23 is also provided which also makes available the breakdown voltage information to the engine controller 19. The, in particular high-frequency-resolution, measuring device 23, which samples in the GHz range, is coupled via a measuring line 23*a* to the spark plug 11 in order to measure the breakdown voltage.

Furthermore, a combustion profile or combustion period controller 25, by means of which the combustion profile is controlled and which can be influenced by setpoint predefined values by the engine controller 19, is operatively connected to the engine controller 19, and is controlled thereby.

A user interface 27 in the form of an operator control information system is also made available at the internal combustion engine 1, which operator control information system can be actuated in a signal-generating fashion by the engine control unit 19. The user interface 27 can be fixedly connected to the internal combustion engine 1, and alternatively or additionally a remote interface module can be provided, for example in the form of a tablet PC or smartphone. Information can be conveyed, preferably in the form of a visual display or else acoustically, via the user interface 27.

Within the scope of the present invention, the superordinate control unit 19 has program code, and in addition characteristic curves are stored, in particular saved in a non-volatile memory, said characteristic curves permitting the engine controller 19 to control the sequencing of the method according to the invention, which will be described in more detail below.

Within the scope of the proposed method, firstly a (proportionality) constant or Paschen's constant K is determined, as a system-specific variable, at the internal combustion engine for the implementation of said method, that is to say within the scope of a measuring setup and using the equation 2) mentioned at the beginning, according to which equation:

$$K = \frac{U_{ZZP}}{p_{zzp} EA_{known}} \qquad \text{Equation 2)}$$

and in which the proportionality constant is denoted by "K", the breakdown voltage (at the ignition time) is denoted by "$U_{ZZP}$", a previously known electrode spacing (at the spark plug) is denoted by "$EA_{known}$", and the cylinder pressure at the ignition time is denoted by "$p_{zzp}$".

The previously known electrode spacing $EA_{known}$ here is an electrode spacing of a new spark plug or of the spark plug 11 in the new state, as is predefined by the manufacturer and as is used for the one-off or initial determination of the proportionality constant K. The further variables "$U_{ZZP}$" and "$p_{zzp}$" are determined by measuring technology using the new spark plug 11, that is to say by means of the cylinder pressure sensor 21 and the measuring device 23 for measuring the breakdown voltage. The proportionality constant K is then determined therefrom computationally for the method according to the invention which can be carried out with the internal combustion engine 1, in particular is saved in the method-controlling control unit 19.

In a first step in the method, a cylinder pressure is measured at the combustion chamber 5 at the ignition time ($p_{zzp}$) and a breakdown voltage ($U_{ZZP}$) is measured at the spark plug 11, in particular continuously with the operation of the internal combustion engine 1. For this purpose, the cylinder pressure sensor 21 and the measuring device 23 for determining the breakdown voltage each (continuously) supply suitable measurement signals to the ECU or the superordinate control unit 19.

In a second step the current electrode spacing EA of the ignition electrodes (at the spark gap) which represents a current ignition electrode state of wear, is now determined, in particular again continuously with the operation of the internal combustion engine 1, on the basis of the cylinder pressure $p_{zzp}$ which is measured in the first step, the measured breakdown voltage $U_{ZZP}$ and the proportionality constant K, determined as described above, i.e. by the ECU 19. In particular the equation 1) which was mentioned at the beginning is used for the determination, according to which equation:

$$EA = \frac{U_{ZZP}}{p_{zzp} K}, \qquad \text{Equation 1)}$$

where the (current) electrode spacing is denoted by "EA", the breakdown voltage (at the ignition time) is denoted by "$U_{ZZP}$", the cylinder pressure (at the ignition time) is denoted by "$p_{zzp}$", and the proportionality constant is denoted by "K".

As the method is continuously carried out, the current electrode spacing EA is therefore constantly known from the equation 1), said electrode spacing EA being also preferably used to determine the service life within the scope of the invention, i.e. in a further step.

FIG. 2 shows by way of example a characteristic curve for the spark plug 11 such as can be found for the determination of the service life, e.g. in the way in which it can be determined empirically. In the characteristic curve which is also preferably stored in the ECU 19, the electrode spacing EA is plotted against the operating hours Bh, consequently the service life, wherein the minimum (previously known) electrode spacing corresponds to that for zero operating hours (EA(0Bh)), and the maximum electrode spacing corresponds to that at the end of the service life ($EA_{max}$), that is to say the maximum possible electrode spacing (with maximum possible burning off of the electrodes). The maximum possible electrode spacing $EA_{max}$ can be determined on the basis of the equation 3) mentioned at the beginning, according to:

$$EA_{max}=EA_{min}+d_{wear\ body}, \quad \text{Equation 3):}$$

where the maximum electrode spacing which characterizes the end of the service life is denoted by "$EA_{max}$", the initial minimum electrode spacing which characterizes the start of the service life is denoted by "$EA_{min}$", and the thickness of the electrode material which can be burnt off is denoted by "$d_{wear\ body}$".

In order to determine the service life, preferably the residual service life of the spark plug 11, the current determined electrode spacing EA is correlated with the characteristic curve. The interval between the currently reached operating hours (corresponding to the current electrode spacing) which can therefore be determined (by forming differences) and the end of the service life (corresponding to the maximum electrode spacing) now indicates the residual service life which is signaled by the ECU 19 via the user interface 27, i.e. with an information signal. As a result, it is now advantageously possible to exchange the spark plug in a way which is appropriate to demand.

In particular, in a step in the method according to the invention after the second step, a combustion parameter of the internal combustion engine 1 is set in parallel with the determination of the service life and signaling, in particular continuously with the operation of the internal combustion engine and on the basis of the electrode spacing which is determined in the second step, in particular an air/fuel ratio is set.

The setting is based on the realization that the electrode spacing EA determines the combustion speed and the flow speed in the combustion chamber 5 decisively, with otherwise unchanged preconditions. For example, in the case of relatively small electrode spacing EA, for example in the case of a new state of the spark plug 11, the combustion is initiated only slowly, in particular jumps over as only a small ignition spark at the spark gap between the electrodes. As a result, the entire combustion proceeds slowly, since the pressure gradient between the prechamber and the combustion chamber 5 is disadvantageous, and consequently only a small ignition jet penetration depth into the combustion chamber 5 is achieved and the combustion in the combustion chamber 5 is delayed as a result.

With the invention there is now provision for the fuel/air ratio λ to be adapted to the current electrode spacing EA, with the result that, for example, an increased quantity of combustion gas is injected into the combustion chamber 5 for a plug state as described above, that is to say an enriched mixture is set at the internal combustion engine 1 (running in the lean mode) with the result that the combustion speed is increased, and consequently relatively fast combustion with a relatively low exhaust gas temperature and improved emission values can be achieved.

If the electrode spacing EA is greater (for reasons of wear), the enrichment can be correspondingly decreased, e.g. the injection period can be shortened, with the result that optimized combustion conditions and emission conditions can be achieved in an advantageously easy way with the invention. In other words, there is provision for the combustion profile to be influenced as a function of the current determined electrode spacing EA, i.e. by setting at least one combustion parameter. For this purpose, suitable control signals are transferred to the combustion profile or combustion period controller 25, i.e. by the ECU 19.

In conclusion it is also to be noted that beading can also be detected on the spark plug 11 with the invention, this concept denoting the formation of very small spheres on the surface of the electrodes, which can grow from several micrometers to e.g. 100 μm. These beads arise during the melting of the electrode and they solidify after the spark has been extinguished. Starting from a certain size, the beads can serve as a surface for further beads so that a type of stalagmite is produced which can reduce the electrode spacing EA in such a way that the spark volume becomes too small for an ignition of the mixture, and consequently ignition of the mixture can no longer take place.

With the method or the currently determined electrode spacing EA, control of the ignition energy is also advantageously possible, during which control the ignition energy which is fed to the spark plug 11 is fed to the spark plug 11 as a function of the determined, current electrode spacing EA, i.e. advantageously in a way appropriate for demand (with the result that beading owing to an excessively high temperature can, for example, be advantageously avoided).

Such a method for controlling the ignition energy is known e.g. from the document DE 10 2013 010 685 A1, the disclosed content of which is included herein by reference.

The invention claimed is:

1. A method for implementation with operation of an internal combustion engine which has a spark plug, having ignition electrodes, arranged at a combustion chamber of a cylinder of the internal combustion engine, the method comprising the steps of:

measuring in a first step, a cylinder pressure of the combustion chamber at an ignition time and measuring a breakdown voltage at the spark plug; and determining in a second step, a current electrode spacing of the ignition electrodes during operation of the internal combustion engine, which represents a current ignition electrode state of wear, based on the measured cylinder pressure, the measured breakdown voltage and a proportionality constant, including determining the proportionality constant as a system-specific variable of the internal combustion engine, based on a previously known electrode spacing, a cylinder pressure at the ignition time and a breakdown voltage of the spark plug.

2. The method according to claim 1, further comprising the step of determining a service life of the spark plug based on the current electrode spacing of the ignition electrodes, which is determined in the second step.

3. The method according to claim 1, further comprising the step of setting a combustion parameter of the internal combustion engine based on the current electrode spacing, which is determined in the second step.

4. The method according to claim 3, wherein the combustion parameter is an air/fuel ratio.

5. The method according to claim 1, including carrying out the method iteratively.

6. The method according to claim 1, wherein the method is carried out with an unused spark plug, wherein the determined current electrode spacing is compared with a new-state setpoint electrode spacing.

7. The method according to claim 1, further including putting out an information signal for an operator of the internal combustion engine based on the determined electrode spacing.

8. The method according to claim 1, including using a characteristic curve that relates the determined current electrode spacing to a service life with the method; and/or using a characteristic curve that relates the determined current electrode spacing to a combustion parameter with the method.

9. The method according to claim 8, wherein the combustion parameter is an air/fuel ratio.

10. The method according to claim 1, wherein the spark plug is a prechamber spark plug; and/or the internal combustion engine is a gas engine.

11. An internal combustion engine, comprising a cylinder with a combustion chamber; a spark plug arranged at the combustion chamber; a cylinder pressure sensor; and a device for measuring breakdown voltage at the spark plug, wherein the internal combustion engine is configured to carry out the method according to claim 1.

* * * * *